US010937399B2

(12) United States Patent
Shemesh

(10) Patent No.: US 10,937,399 B2
(45) Date of Patent: Mar. 2, 2021

(54) POSITION DETECTION APPARATUS FOR A MOVABLE ELECTRONIC PERCUSSION INSTRUMENT

(71) Applicant: Guy Shemesh, Haifa (IL)

(72) Inventor: Guy Shemesh, Haifa (IL)

( * ) Notice: Subject to any disclaimer, the term of this patent is extended or adjusted under 35 U.S.C. 154(b) by 0 days.

(21) Appl. No.: 16/836,818

(22) Filed: Mar. 31, 2020

(65) Prior Publication Data

US 2020/0312285 A1 Oct. 1, 2020

Related U.S. Application Data

(60) Provisional application No. 62/827,132, filed on Mar. 31, 2019.

(51) Int. Cl.

| | |
|---|---|
| ***G10D 13/065*** | (2020.01) |
| ***G10D 13/10*** | (2020.01) |
| ***G10H 3/14*** | (2006.01) |

(52) U.S. Cl.

CPC ..... *G10D 13/065* (2013.01); *G10D 13/26* (2020.02); *G10H 3/146* (2013.01); *G10H 2220/185* (2013.01); *G10H 2220/391* (2013.01); *G10H 2230/331* (2013.01)

(58) Field of Classification Search

CPC ..... G10H 2220/185; G10H 2220/391; G10H 2220/331

See application file for complete search history.

(56) References Cited

U.S. PATENT DOCUMENTS

| | | | | |
|---|---|---|---|---|
| 5,140,889 | A * | 8/1992 | Segan | G10H 1/32 84/723 |
| 5,453,567 | A * | 9/1995 | Brinson | G10D 13/00 84/104 |
| 6,201,173 | B1 * | 3/2001 | Black | G10D 13/11 84/422.1 |
| 7,294,778 | B2 * | 11/2007 | Susami | G10H 3/146 84/411 P |
| 7,468,483 | B2 * | 12/2008 | Yoshino | G10H 1/34 84/104 |
| 7,560,638 | B2 * | 7/2009 | Susami | G10H 3/146 84/422.3 |
| 7,608,771 | B2 * | 10/2009 | Fournier | G10D 13/11 84/422.1 |
| 7,671,263 | B1 * | 3/2010 | Coady | G10D 13/065 84/422.3 |

(Continued)

*Primary Examiner* — Robert W Horn

(57) ABSTRACT

An electronic hi hat cymbal apparatus for detection of vertical movement, including an electronic percussion instrument, configured to be reversibly attached to a shaft of a stand such that the electronic percussion instrument is movable upward and downward by a foot pedal operating the shaft, and a coil, induced with alternating current so as to produce magnetic field in the vicinity thereof by an electronic circuit which is configured for oscillation, and a core, comprising metallic material, disposed such that it is overlapping with the coil during play. The overlapping portion is configured to vary with the upward and downward movement of the electronic percussion instrument such that eddy currents are formed in the core substantially in the overlapping portion thereof, thereby an output signal which vary in accordance to the overlapping portion can be formed by the electronic circuit.

28 Claims, 6 Drawing Sheets

(56) References Cited

U.S. PATENT DOCUMENTS

| | | | | |
|---|---|---|---|---|
| 7,943,841 | B2 * | 5/2011 | Toda | G10H 1/348 84/422.3 |
| 8,344,235 | B2 * | 1/2013 | Steele | G10H 1/348 84/615 |
| 8,389,848 | B1 * | 3/2013 | Baker | G10H 1/348 84/746 |
| 8,410,348 | B1 * | 4/2013 | Hsieh | G10H 1/32 84/743 |
| 8,785,758 | B2 * | 7/2014 | Wissmuller | G10H 1/348 84/615 |
| 9,053,693 | B1 * | 6/2015 | Wei | G10D 13/065 |
| 9,646,593 | B2 * | 5/2017 | Watanabe | G10H 3/146 |
| 10,079,008 | B2 * | 9/2018 | Suitor | G10H 3/186 |
| 2012/0318119 | A1 * | 12/2012 | Coady | G10D 13/065 84/422.3 |
| 2013/0312590 | A1 * | 11/2013 | Truchsess | G10H 3/146 84/725 |
| 2016/0140945 | A1 * | 5/2016 | De Virgiliis | G10D 13/26 84/725 |
| 2020/0312285 | A1 * | 10/2020 | Shemesh | G10D 13/26 |

* cited by examiner

POSITION DETECTION APPARATUS FOR A MOVABLE ELECTRONIC PERCUSSION INSTRUMENT

CROSS-REFERENCE TO RELATED APPLICATIONS

This application claims the benefit of U.S. Provisional Application No. 62/827,132, filed Mar. 31, 2019.

BACKGROUND OF THE INVENTION

1. Field of the Invention

This invention relates to electronic percussion instrument such as an electronic hi hat cymbal, which outputs electronic signals when struck, the electronic signals are used by an external processing system to produce a suitable sound in response. Furthermore, the invention relates to an apparatus capable of detection the current position of electronic hi hat cymbal when operated by foot pedal on a stand.

2. Description of Related Art

The 'hi hat' is an element of a drum kit that allows a drummer to play a cymbal-like instrument with the foot as well as the hands. So-called hi hat controllers have been widely used in electronic drums for detection of the foot depressing a pedal to move a top hi hat cymbal into contact with a resting bottom hi hat cymbal. Often in electronic drums the bottom hi hat cymbal is omitted, while more rarely the bottom cymbal is kept for aesthetic reasons and the hi hat controller is integrated into the bottom cymbal. In either configuration, the hi hat controller is positioned under the top cymbal and is used to detect the foot action operating to move the top hi hat cymbal, and to convert this movement into an electronically measurable quantity which is sent to a centralized computing device often called the sound module.

For example U.S. Pat. No. 7,468,483 discloses a hi hat controller mechanically operating a variable resistance element positioned vertically off axis. However, due to the internal mechanism, the height of the hi hat controller forces the player to raise the hi hat cymbal height significantly, thus affecting the playability. Furthermore, increasing the opening stoke comes at the cost of further raising the top hi hat cymbal. Still further, the invention involves continual engagement of mechanicals components during motion and therefore has limited service life. Inventions U.S. Pat. Nos. 7,473,834, 7,459,626 and 8,742,244 disclose a sensor based on a variable resistance operated by means of a conical compression spring. However these methods adversely affect the playability because of the generally limited distance between the detectable open and closed positions of the top cymbal, often referred to as the 'opening stroke'. This is because the disclosed conical compression spring decreases the applied force on the disclosed resistive element as the radii becomes larger towards the base of the spring. Thus further enlargement of the conical spring to improve the opening stroke is limited. Furthermore, fatigue due to wear of the resistive element by continual mechanical motion limits the service life of those inventions. U.S. Pat. No. 8,785,758 discloses a hi hat controller in which a mechanical shutter selectively covers a portion of a light path between a led and a photodiode. However this generally has the problem of accuracy and the maximum opening stroke is generally limited as well.

There is thus a long felt need for an electronic hi hat having better playability by providing an enlarged opening stroke while maintaining the player's comfort by using an apparatus of reduced overall height when seated on a stand. Also there is a need for maintaining high degree of position detection accuracy throughout the entire playable range, while further improving the service life and reliability of the detecting apparatus.

BRIEF SUMMARY OF THE INVENTION

In one embodiment of the invention a hi hat controller for detection of vertical position of an electronic percussion instrument which is adapted to be operated upward and downward during play on a stand having a foot pedal and a shaft which is movable upward and downward by the foot pedal of the stand is provided, comprising a housing, disposed on the stand below the electronic percussion instrument, and a coil supported by the housing, and an electronic circuit constructed for producing alternating electrical current in the coil so as to induce magnetic field in the vicinity thereof, and a core, comprising a metallic material, variably positioned in the vicinity of the coil induced with magnetic field, the position of the core relative to the coil is configured to change as the electronic percussion instrument is being operated upward and downward during play, wherein there is no direct contact between the core and the coil, wherein an electrical output signal representative of the measured position is produced by the electronic circuit in accordance with the position of the core relative to the coil.

In another aspect of the invention an embedded position detection apparatus is provided, comprising an electronic percussion instrument, configured to be movable upward and downward on a stand during play, further comprising a striking surface on an upper face thereof for receiving percussion strokes and a support frame for supporting the electronic percussion instrument from below, such that an interior section is formed between the support frame and the striking surface, and a coil disposed and supported in the interior section, and an electronic circuit constructed for producing alternating electrical current in the coil so as to induce magnetic field in the vicinity thereof, and a core, comprising a metallic material, stationarily positioned on the stand external to the electronic percussion instrument from below such that the core is adapted to be variably protruding into the bore of the coil through an opening on a central lower portion of the support frame as the electronic percussion instrument is being moved upward and downward on the stand during play, wherein an electrical output signal representative of the measured upward and downward position of the electronic percussion instrument is produced by the electronic circuit in accordance with the position of the core relative to the coil.

In some embodiments the core is configured to have a tubular shape and is made of iron and, the coil is configured to have tubular shape and, the core is variably positioned upward and downward in the bore of the coil during play.

Also in some embodiments the coil and the core are arranged generally concentric about the shaft of the stand.

Also in some embodiments the electrical output signal is based on the current consumption of the electronic circuit.

Also in some embodiments the current consumption of the electronic circuit is configured to be less than 1 milliampere.

Also in some embodiments the electronic percussion instrument is configured to have a shape of a top hi hat cymbal.

In some embodiments the electronic circuit is disposed in the interior of the housing, so as to produce alternating current adjacent to the coil. In other embodiments the electronic circuit is disposed exterior to the housing on an external device, thereby alternating current is remotely produced and transmitted to the coil.

In one embodiment additionally includes a bowl shaped member, stationarily disposed on the stand below the electronic percussion instrument so as to simulate the look of an acoustic hi hat cymbal.

In other embodiment the core and the coil are incorporated into the foot pedal of the stand, for detection of the upward and downward motion of the electronic percussion instrument.

BRIEF DESCRIPTION OF THE DRAWINGS

Embodiments and features of the present invention are described herein in conjunction with the following drawings.

Figure 1:
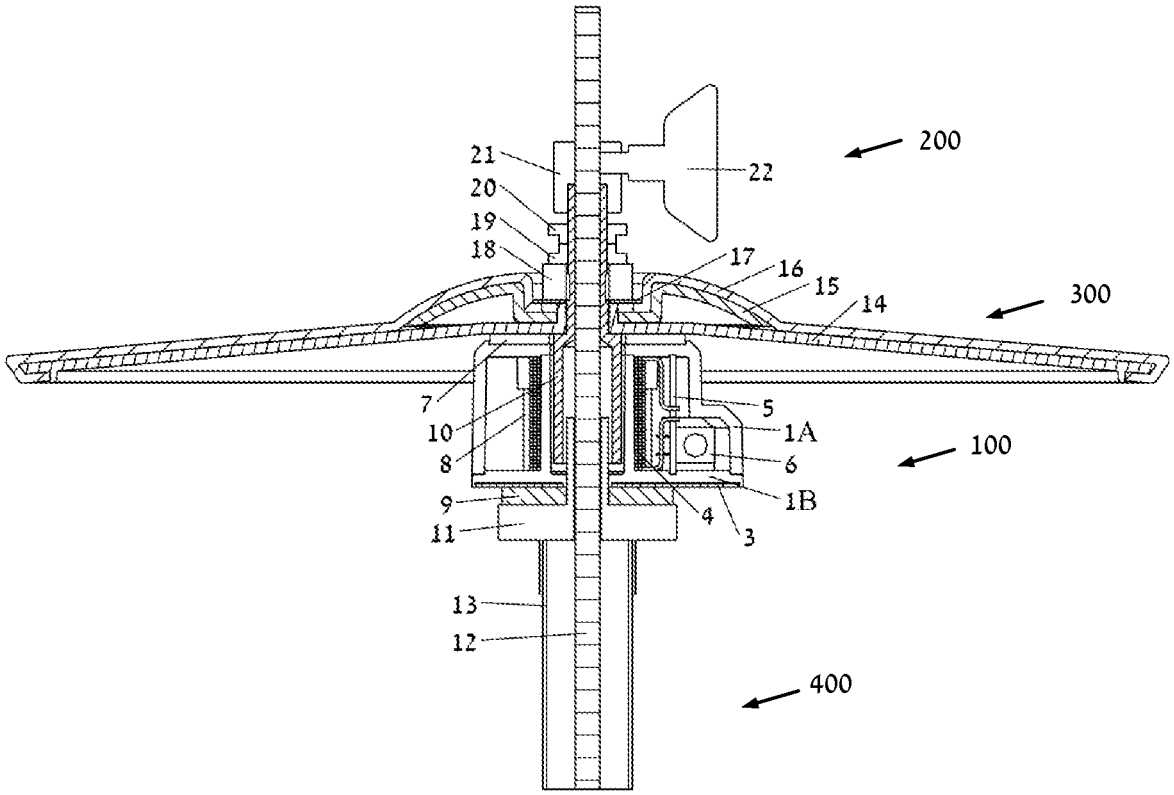
FIG. 1 shows a cross-sectional view of the electronic percussion instrument according to the first embodiment of the invention.

It should be understood that the drawings are not necessarily drawn to scale and that all embodiments are meant as nonlimiting examples.

DETAILED DESCRIPTION OF PREFERRED EMBODIMENTS

The present invention will be understood from the following detailed description of preferred embodiments, which are meant to be descriptive and not limiting. For the sake of brevity, some well-known features, methods, systems, procedures, components, circuits, and so on, are not described in detail.

This invention relates to electronic percussion instruments such as electronic drums and cymbals, and more specifically to the hi hat mechanism in which a foot action on a foot pedal controls the opening distance between the top and bottom hi hat cymbals. The hi hat controller is positioned under the top cymbal and is used to detect the foot action operating to move the top hi hat cymbal, converting this movement into an electronically measurable quantity which is sent into a centralized computing device often called the sound module.

It is emphasized that throughout the description hereinbelow that the term 'electronic percussion instrument' is used interchangeably with 'top cymbal' and also with 'top hi hat cymbal'. All terms should be understood as having generally the same meaning, referring to an electronic percussion instrument which is designed to follow the shape and function of a top cymbal of an acoustic hi hat but with much lesser noise produced when struck.

In the present invention a novel hi hat controller is introduced which enables large opening stroke, thus greatly improving the playability of the hi hat, and which can withstand long term use since the sensitive components of the sensor have no mechanical contact. Furthermore, the present invention is designed such that its active circuit uses an extremely low amount of power, eliminating the need for a dedicated power supply and simplifying the connection to the sound module which requires only 2 wires. Still further, as the sensor disclosed presents a pseudo resistive element, which means it may been regarded as electrically equivalent to a resistor when being measure from external circuit, therefore the sound module can be made compatible with this sensor as well as other resistance based hi hat controllers. Still further, the present invention allows for an excellent, almost one to one, ratio between the total hi hat controller height to the maximum detectable opening stroke. In other words, the player benefits from an excellent range of detectable opening stroke while the increase in the playing surface height is kept to a minimum. Still further, the present invention allows for excellent accuracy in the detected opening stroke which follows a generally linear relationship with the output voltage across wide range of operation. Furthermore, the present invention also discloses a second embodiment that embeds the required elements of the apparatus into the electronic percussion instrument, eliminating the need for a separate housing for the hi hat controller.

The present invention discloses the construction of a pseudo resistive element using an active circuit which is based on the principles of magnetic fields. The sensor disclosed presents a height-controlled resistance to a measuring circuit in the sound module, behaving electronically much like an off the shelf potentiometer, but without requiring any friction between the moving elements of the sensor. Thus the hi hat top cymbal height can be detected accurately by the sound module.

In the first embodiment of the invention hi hat controller is introduced and in the second embodiment the required elements of the hi hat controller are embedded into the electronic percussion instrument itself. Both embodiments are designed to enable a large opening stroke, defined as the detectable distance between a fully open to a fully closed hi hat, thereby greatly improving the playability of the hi hat, and which can withstand long term use since the sensitive components of the sensor suffer no mechanical contact. Furthermore, the present invention is designed such that the sound module can be made to be compatible with other variable resistance controllers, requiring only 2 wires for connection to the sound module without requiring additional power supply. Still further, the present invention allows for excellent ratio between the total hi hat controller height to the maximum detectable opening stroke. In other words, the player benefits from an excellent range of detectable opening stroke while the increase in the playing surface height is kept to a minimum. Still further, the present invention allows for excellent accuracy in the detected opening stroke which generally follows a linear relationship with the output voltage.

Figure 9:
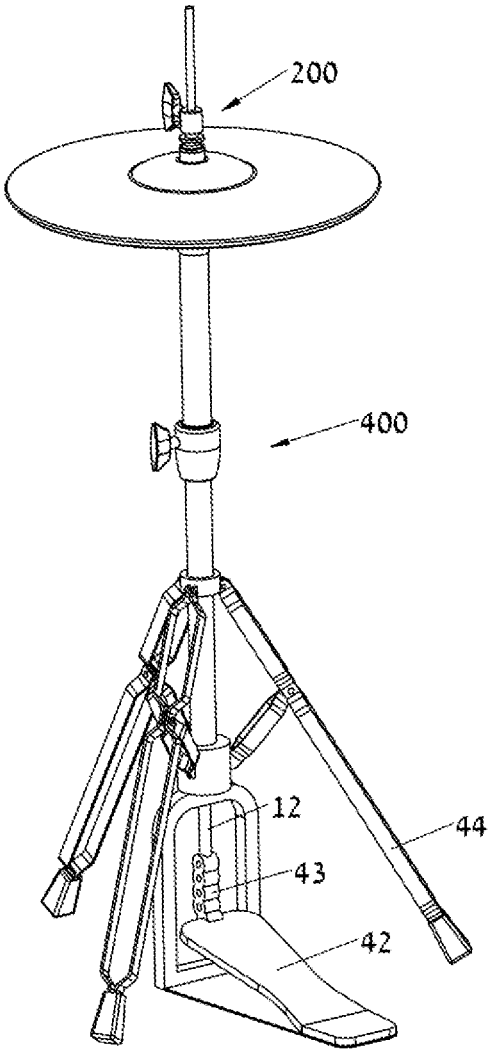
FIG. 9 show typical hi hat stand, upon which the electronic percussion instrument is installed according to the different embodiments of the invention.

Referring to FIG. 9, a typical electronic hi hat assembly is presented. The assembly is designed to be mounted on an off the shelf typical stand 400, originally used for mounting acoustic hi hats. The stand 400 is used as a reference for all the embodiments according the invention. The stand 400 typically has three support arms 44 so as to balance it on the floor. Furthermore, the stand 400 has a foot pedal 42 coupled to a shaft 12 by means of a chain 43, where the player's foot acting on the foot pedal 42 causes the shaft 12 to move up and down. Not shown in the figure is a spring internal to the stand 400 which is used to push the shaft 12 and the foot pedal 42 upwards when the player's foot is being lifted up during play. Therefore, the player is able to move the shaft 12 upwards and downwards by the control of the foot, and as will be shown hereinbelow, the electronic percussion instrument of the different embodiments of the invention is reversibly attached to the shaft 12 so as to allow upward and downward motion of the electronic percussion instrument during play.

Figure 2:
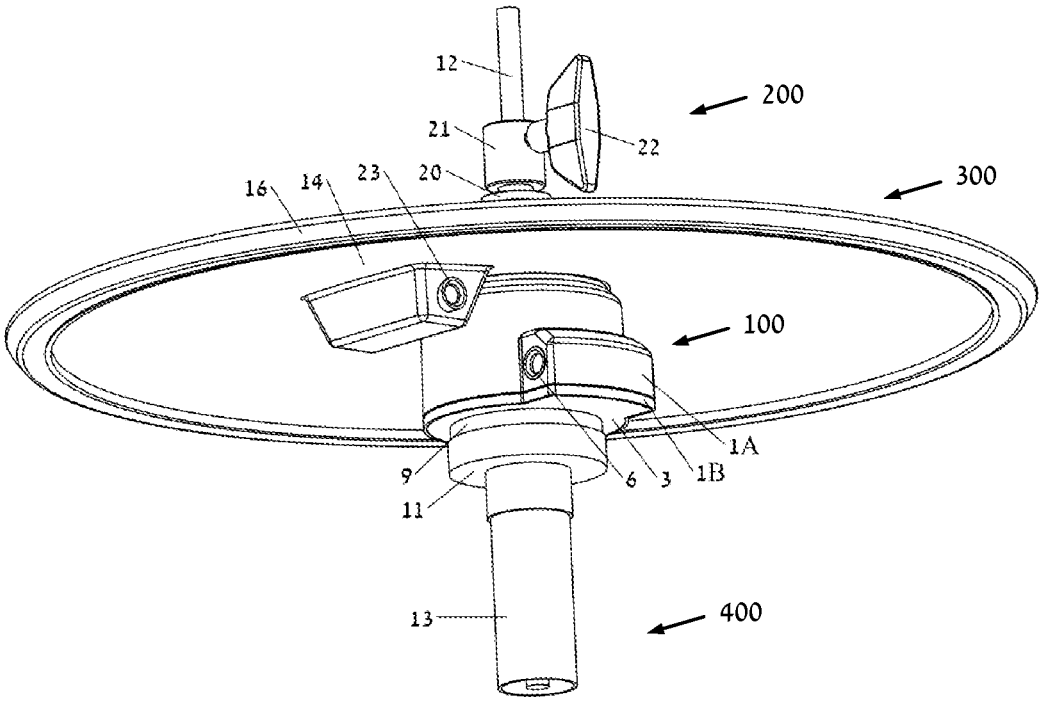
FIG. 2 shows a perspective view of the underside of electronic percussion instrument according to the first embodiment of the invention.

Referring to FIGS. 1-3, partially displayed is the stand 400's top portion where a tube 13 is coupled to a cymbal seat 11 acting as a top cap for the tube 13 and which has a center hole where a shaft 12 is fitted concentric to the tube 13. Attached to the shaft 12 is a hi hat clutch 200 for holding a top cymbal 300. The hi hat clutch 200 consists of a top nut 21 having a center hole in which the shaft 12 is fitted, and further having a horizontal threaded hole coupled to a mating thread of a butterfly screw 22, allowing for fastening the butterfly screw 22 to the top nut 21. This also creates pressure against the shaft 12 from one side while on the other side the top nut 21 provides an opposing force on the shaft 12 to reversibly mate the hi hat clutch 200 and the shaft 12. Furthermore, the top nut 21 has a bottom threaded hole fastened to a male thread of a core 10. Similar to the top nut 21, the core 10 has a center hole through which the shaft 12 is fitted, as well as a male thread through which two locking nuts 19, 20 are fastened against each other such that a locking force is created, effectively allowing the locking nuts 19,20 to be held fixed to a desired location on the male thread of the core 10. On the underside of the nut 19 a washer 18 is disposed, encircling the core 10. The washer 18 is typically made of felt or rubber and is pressing against a top cymbal 300 which is affixed between the core 10 and the washer 18. Since the washer 18 is not stiff, some controlled movement of the top cymbal 300 is allowed during play, while still keeping the hi hat clutch 200 and the top cymbal 300 connected as one assembly. Therefore, the player is able to adjustably affix the hi hat clutch 200 and top cymbal 300 into a favorable position on the shaft 12 using the butterfly screw 22, as well as to play on the top cymbal with hand action by using drum sticks. The player is also able to move the top cymbal 300 up and down by foot action pressing on a foot pedal 42 of the stand 400.

Referring to FIGS. 1 and 2, a typical electronic cymbal is disclosed according to the first embodiment of the invention. The top cymbal 300 is described for illustrative purposes of the assembly of the hi hat controller 100 but generally the top cymbal 300 is not considered as an essential part of the first embodiment, but rather as the element for which the vertical position is sought for. The top cymbal 300 is configured to have a shape resembling of the top cymbal of an acoustic hi hat and consists of a cymbal base 14 acting as a rigid support member on which a cymbal cover 16 and a cymbal cup 15 are disposed. The cymbal cup 15 is optional and is located in the center of the cymbal base 14 to support a so called 'bell area' under the cymbal cover 16. The cymbal cover 16 is made of elastic material such as rubber to soften the noise generated by a percussion stroke impinging on the top cymbal 300. A cymbal plate 17 is located over the center portion of the cymbal cover 16, affixing the cymbal cover 16 to the cymbal base 14 by means of screws, not shown.

Figure 3A:
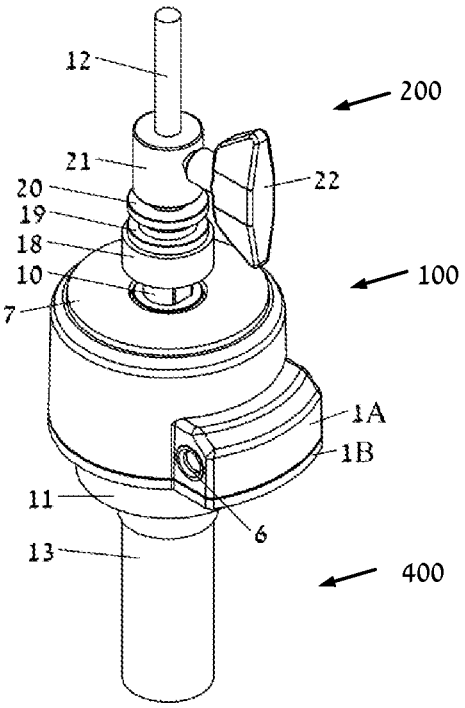
FIG. 3A,B show the hi hat controller with different positions of the hi hat clutch in perspective views according to the first embodiment of the invention.
Figure 3B:
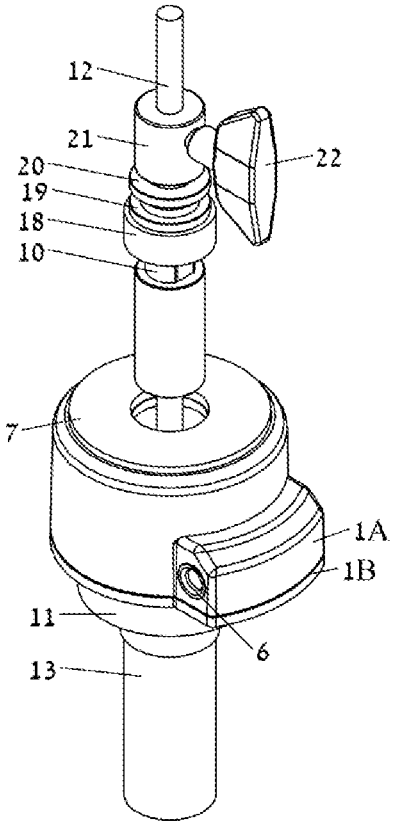
Figure 4:
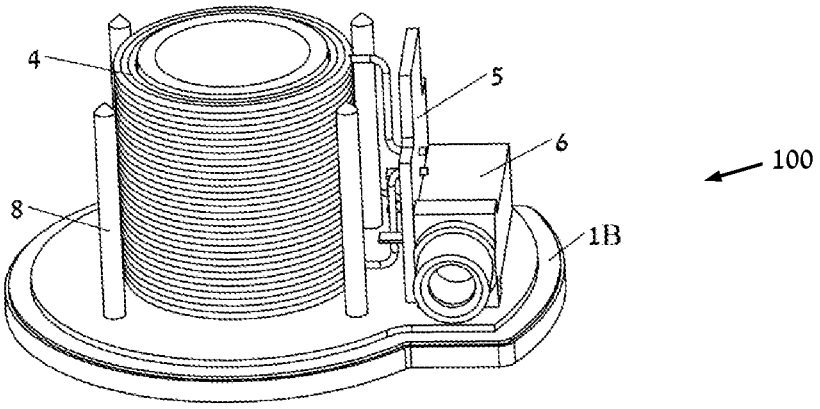
FIG. 4 shows the internal parts of the hi hat controller according to the first embodiment of the invention.

Referring to FIGS. 1-4, the hi hat controller 100 comprise of a housing 1 having a housing bottom 1B having a center hole for mating with a center protrusion in the cymbal seat 11, securing the housing 1 of the hi hat controller 100 onto the stand 400. The housing bottom 1B is supported by a bottom plate 3 of rigid material, the bottom plate 3 is seated over an optional stand cushion 9, typically made of non rigid material such as felt and is part of the off the shelf stand 400. It should be noted however that some off the shelf stands 400 may not provide a stand cushion 9 and as an alternative the cymbal seat 11 is made with slightly elastic rubber. In either case, the bottom plate 3 of the hi hat controller 100 is typically made of metal and provides a horizontal face for support of the forces applied to the hi hat controller as the player presses a top cymbal 300 onto the hi hat controller 100 either with foot or with percussion stroke action. A housing top 1A is disposed over the housing bottom 1B, forming the external frame of the hi hat controller 100, generally referred herein as the housing 1. The housing top 1A includes bosses for mating screws 8 passing through the housing bottom 1B and affixing the housing top 1A with the housing bottom 1B. The housing top 1A has a generally cylindrical shape with an extension to one side to allow space for a connector 6. The connector 6 is mounted on a printed circuit board, or PCB 5, disposed in the interior of the hi hat controller which is enclosed by the housing 1. A side hole in the housing top 1A allows for slight outward protrusion of the connector 6 for mating a suitable cable so as to form an electrical connection between the sound module and the hi hat controller 100. The cable and sound module are not shown in the figures. Furthermore, a coil 4 is disposed on a cylindrical portion of the housing bottom 1B such that the coil is concentric to the shaft 12 and to a central hole formed in the housing 1 of the hi hat controller 100. The coil 4 is typically made of low resistance copper wire and is extending through the maximum possible length allowed by the interior of the hi hat controller 100 as shown in FIGS. 1 and 4. The coil 4 extends two wire leads which are connected to the PCB 5. In one embodiment of the invention, the PCB 5 includes additional electronic components, not shown, which function as an electronic circuit such as the one shown in FIG. 5B. In another embodiment of the invention, the electronic circuit such as the one shown in FIG. 5B is not included into the PCB 5 but rather disposed external to the hi hat controller 100. However the principle of operation as described herein below is the same. It should be further noted that the number of turns shown in FIGS. 1,4 are significantly reduced and the copper wire diameter enlarged for the sake of illustration and better understanding of the figures. An in depth discussion of the coil 4 is key to the present invention and is discussed herein below.

Referring to FIGS. 1-4, the hi hat controller 100 has a hole along its principal axis in which the core 10, being part of the hi hat clutch 200, is moved up and down when the player depresses a foot pedal 42 which is part of the stand assembly 400. The foot pedal 42 is shown in FIG. 9. The coil 4 is operated with an alternating voltage as generated by a typical circuit such as in FIG. 5B, which induces alternating current in the coil 4 which in turn generates a magnetic field in elliptical paths passing largely axially though the length of the coil and encircling the coil. Typically, the core 10 comprises a metallic material having high magnetic permeability. When introduced into the opening in the hi hat controller as emphasized in FIGS. 3A,3B and thus into the bore of the coil, the metallic material of the core 10 induces energy loss since by Maxwell's equations alternating magnetic field must co-exist with a complimentary electric field which cause free electrons to move, thus forming so called eddy currents in the core 10. Energy is lost in the process and converted into heat since the eddy currents flowing through the small but non zero resistance of the metallic material comprising the core 10. The current flow necessarily mean energy loss, the amount of which is essentially proportional to the protrusion of the core 10 into the bore of the coil 4. This can be measured by the sound module, for example by simply measuring the current consumption of the circuit such as described in FIG. 5B by means of ADC converter, for example by using the circuit such as describe in FIG. 5A.

It should be noted that in another embodiment of the invention, not shown in the figures, a slight deviation in mechanical arrangement of the first embodiment is possible. According to that embodiment, the hi hat controller's housing 1 is incorporated into the foot pedal 42 of the stand, for detection of the upward and downward motion of the electronic percussion instrument. Accordingly, the core is configured to be protruding downward from the foot pedal 42, such that it is moving upward and downward in the bore of the coil when the player is operating the foot pedal.

In a sense the design goal of the pair consisting of the coil 4 and the core 10 acting as its movable core material is the opposite to the design goal of a good inductor or transformer. In the case of inductor or transformer, core losses are usually minimized with several techniques such as by using low conduction high permeability materials, or by using techniques to limit current flow in a conductive materials, i.e by using insulated laminations of the core material. In this invention however, maximum energy losses are desired as a means to create a detectable difference between the hi hat open state as in FIG. 3B and hi hat closed state as in FIG. 3A and in every position therebetween.

The material of choice for the core in the current invention is iron since it serves a dual purpose. First, iron is well known to have high relative magnetic permeability, typically on the order of several thousands, which significantly increases the magnetic flux produced by the coil 4 comparing to when the core is not present. Therefore, increasing the magnetic flux also assists in increasing the energy loss in the system. Second, the iron is chosen for its conductivity since this allows core losses to occur by eddy currents.

It should be noted, however, that the same invention with slight changes in materials could also have been optimized for energy efficiency instead of energy loss. Instead of solid iron, the core 10 can also be made of the same core materials used to construct inductors and transformers, thus allowing for high relative permeability and low conductivity for the minimization of core losses. For example, the ferromagnetic material Manganese-Zinc Ferrite has a typical relative permeability of 5000 and typically may be effective from DC to 1 MHz. Therefore, in a hi hat closed state as in FIG. 3A, the core is operated as an inductor with significantly more energy efficiency than a so called air coil such as the case of FIG. 3B. The much higher magnetic flux in the center of the coil 4 during a closed state reinforces the current running through the coil 4, comparing to a fully open state in which the magnetic flux is much lower. In the current invention however, the focus is not on this construction, since it is easier and more cost effective to construct the core 10 out of solid iron by means of CNC turning operation, followed by typical nickel or chrome plating for aesthetic purposes and for prevention of rust.

It should be also noted that through the discussions herein above, the shaft 12 was ignored and its effects were omitted from the discussion of the principle of operation of the invention. The shaft 12 is typically supplied as part of off-the-shelf hi hat stands 400 and typically is made from iron as well. Since the shaft 12 is inserted in the center of the coil 4, there will always be some degree of core losses due to the eddy currents developing in the shaft 12, and since the cross section of the shaft is constant the losses are constant as well independent of whether the hi hat is held in its open or closed position or anywhere in between. Therefore, those constant losses have no significance for this invention and thus can be ignored.

Another important aspect of the invention is the simplification of the interface to the sound module. While typical active circuits require a minimum of 3 wire leads, e.g. voltage source, ground and signal output, the present invention only uses 2 wire leads, i.e voltage source and ground. The output of the circuit is the amount of current drawn. The output of the circuit functions much like a variable resistor, i.e when put under constant voltage, the current flowing between the 2 wire leads is a function of the variable resistivity. In the present invention, insertion of the core 10 into the bore of the coil 4 will increase the current draw and vice versa. Oftentimes, it is more practical to measure voltage than current, i.e by means of an analog to digital converter IC, or ADC, so the measurement circuit in the sound module may use a voltage divider such as the one depicted in FIG. 5A which is discussed in detail below. The voltage measured at the "To ADC" point is depending on the current drawn by the hi hat controller 100, since by ohm's law any change in current will induce a voltage drop on the resistor R6. Furthermore, the typical circuit disclosed for the present invention generally consumes less than 1 milliampere of current, abbreviated as 1 mA, typically only 0.1-0.2 mA. It is therefore clear that a typical sound module can easily source at such low current without requiring a dedicated power supply design for sourcing the hi hat controller 100. Still further, since the output of the circuit can be measured by any standard techniques for resistance measurement, the sound module interfacing to the present invention can also be made compatible with other hi hat controllers known to the art that are based on a true variable resistance element. In this sense, the active circuit can be regarded as a 'pseudo variable resistor' which has the benefit of non contact operation.

Figure 5A:
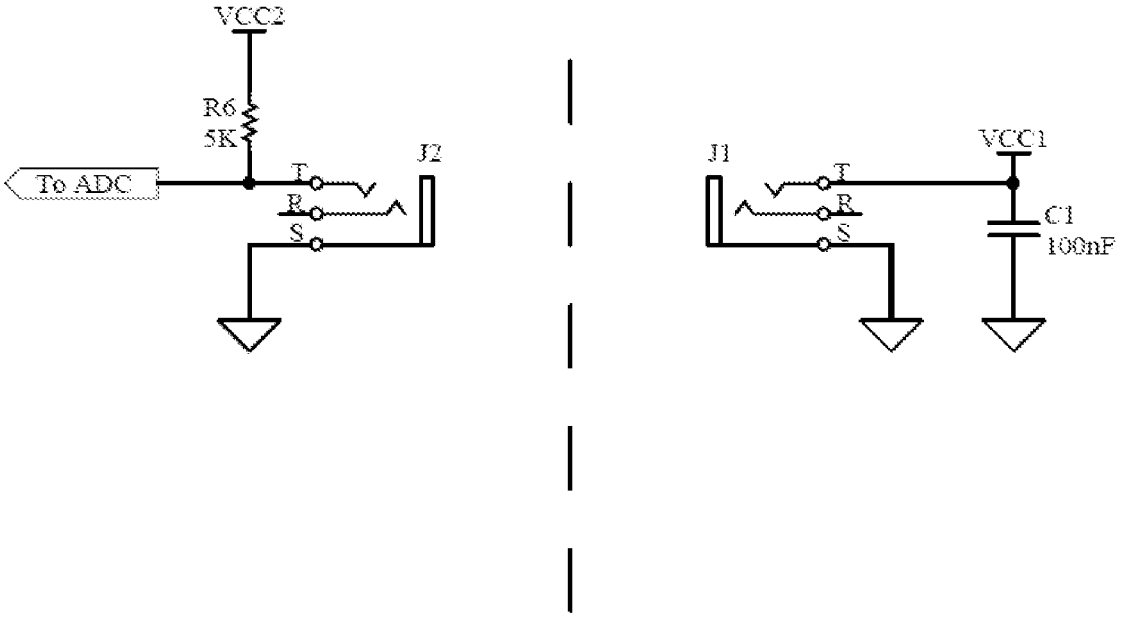
FIGS. 5A, 5B show exemplary circuits of the hi hat controller and entrance point of the sound module according to the embodiments of the invention.
Figure 5B:
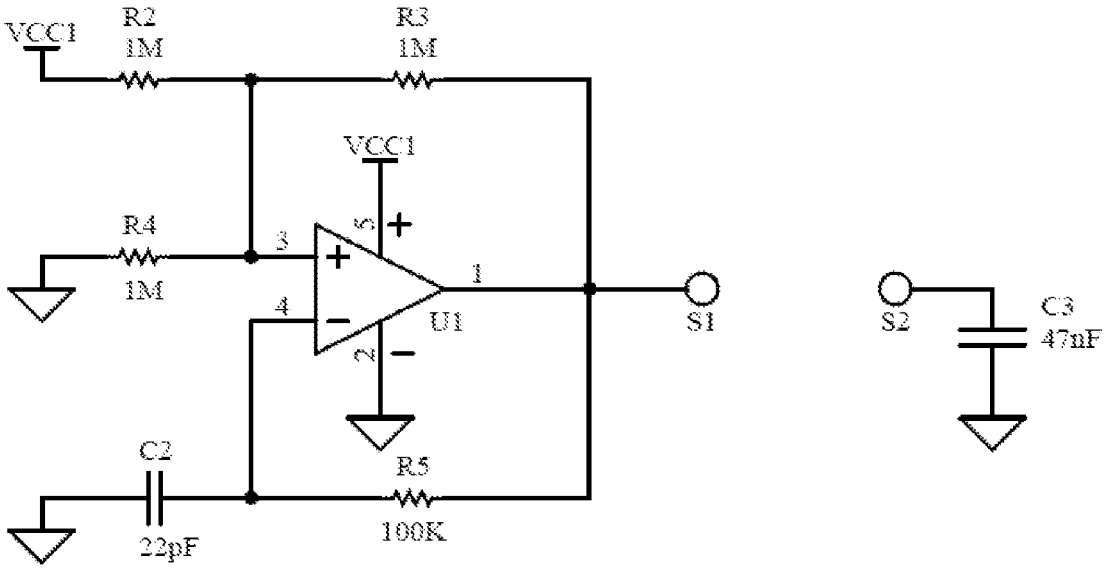

Reference is made to FIG. 5B, representing in one embodiment of the invention a typical circuit assembled on the PCB 5 of FIGS. 1,4 and to FIG. 5A representing a potion of a circuit in the sound module connected to the circuit 5B by a cable running through the connectors J1 and J2. The sound module uses a supply voltage VCC2, typically 2.5V-5V, for sourcing the J2 connector 'T' lead via a resistor R6. The resistor value of 5K Ohm is typical but other values may work as well. The connector 6 of FIGS. 1-4 is denoted as J1 in FIG. 5B and is selected as a typical ¼" TRS often used in electronic drums as well as other audio equipment. The connector has 3 leads however only two leads are used in this invention. The 'T' lead of J1 receives the voltage VCC1 for the circuit, typically 2.5V-5V, while the 'S' lead of J1 receives a reference potential, or ground, denoted by a triangle throughout FIG. 5. The circuit in FIG. 5B is a standard square wave output oscillator known to the art, operated around a comparator operational amplifier denoted as U1. Although many devices may work, in the present invention the off the shelf integrated circuit 'TS881' was selected as U1 because of it's ultra low supply current requirements, typically consuming 210 nA, and because of it's operation under a wide range of supply voltage of 0.85V-5.5V. The circuit described is a relaxation or comparator based oscillator and the principal of operation is as follows. Resistors R2 and R4 form a voltage divider between VCC1 and ground and the output pin 1 of U1, which will be shown herein below to oscillate between VCC1 and ground, contributes to the voltage divider as well via resistor R3. In the case the output at pin 1 of U1 is at VCC1, the voltage at pin 3 of U1 will be ⅔ of VCC1 calculated as a voltage divider of R2-4, while in the case the output at pin 1 of U1 is at ground, the voltage at pin 3 of U1 will be ⅓ of VCC1 by the same reasoning. Now, the output of U1 at pin 1 charge and discharge an RC circuit denoted by R5 and C2, with time constant of 2.2 uS, controlling U1 inverting input at pin 4. Since the inverting pin 4 of comparator U1 is designed to follow its non inverting pin 3 through the feedback of R5, charging of C2 from ⅓*VCC1 to ⅔*VCC1 will occur when pin 1 is at VCC1 and discharging C2 from ⅔*VCC1 to ⅓*VCC1 will occur when pin 1 is at ground. Thus the circuit 5B operates a generally square wave output at pin 1 of U1. The theoretical frequency of operation is inversely proportional to the RC time constant of R5 and C2, completing a full revolution after about 4.4 uS and predicting oscillation frequency of around 227 KHz, but in practice measured values vary around 120-180 KHz, with dependence on the operating voltage VCC1. This can be explained mainly due to the added propagation delay between transitions of the device U1. However, in practice it follows that the exact frequency of operation is not critical and can be selected over a wide range by different component values and also by altering the number of turns of the coil 4. The circuit further denotes S1 and S2, these are contact holes configured for connection to the two wire leads of the coil 4, without giving preference to the polarity of the connection. The coil 4 is therefore connected to the output of the comparator, receiving continuous square waveform on S1 while on S2 the coil 4 is connected to a capacitor C3. The value of the capacitor C3 is selected to be 47 nF, although in practice many values may work as well, as this value is large enough so that C3 cannot fully charge or discharge in a single cycle of the square waveform applied on the coil 4. Hence the capacitor C3 maintains a generally constant mid voltage of VCC1/2 as a filtered average of the alternating voltage between VCC1 and ground applied via the coil 4. Hence, it follows that in each cycle, the current through the coil 4 flows from S1 to S2 for half a cycle and from S2 to S1 for half a cycle, following an alternating current pattern of a triangle waveform. It should also be noted that when the U1 output at pin 1 is at VCC1 for half a cycle, there is a larger current draw from the VCC1 rail input to the circuit 5B via a typical circuit 5A. However, R6 is limiting the available current at the output of the sound module therefore the capacitor C1 is used as a reservoir, serving double purpose. First C1 supply the current needed while current is drawn during the charging half cycle of the coil 4 with VCC1 and second the capacitor averages the output current draw of the circuit 5B as seen by the sound module, effectively presenting to the sound module an averaged DC current.

Figure 6:
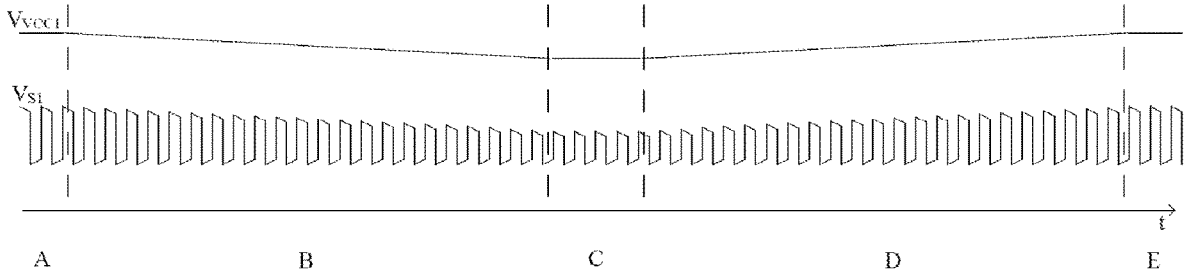
FIG. 6 shows an exemplary waveform of circuit of FIG. 5B, as it changes due to position changes of the electronic percussion instrument according to the embodiments of the invention.

As an illustrative example, consider the scenario presented at FIG. 6 where a graph of the voltage at the node $V_{VCC1}$—the output presented by hi hat controller 100, and of the voltage at the node $V_{S1}$—the voltage presented to the coil 4 by the oscillating circuit. FIG. 6 follows five states denoted A-E, illustrating as an example the state of the core 10 relative to the coil 4. In state A, the core 10 is outside the bore of the coil 4, as seen in FIG. 3B. In state B, the core is being inserted into the bore of the coil 4, progressing towards full insertion as in FIG. 3A, which arrives at state C. In state D the core is being pulled out of the bore of the coil 4, progressing towards full exit as in FIG. 3B, which arrives at state E. Consider the state A, where the core is pulled away from the coil 4. In this state the average current draw is the lowest, as the coil 4 effectively acting as an air coil where it's magnetic energy is generally preserved. In this state the coil 4 uses its stored energy to charge the capacitor C3 of FIG. 5B and also to resist current changes when the oscillator output $V_{S1}$ changes from VCC1 to ground and vice versa. Hence the voltage drop across the resistor R6 of FIG. 5A is lower compared to states B-D and the circuit represents higher output voltage of $V_{VCC1}$ and wider span of the oscillator voltage $V_{S1}$. Now, consider state B where the core 10 is being inserted into the bore of the coil 4. In this state there is increased energy loss as part of the coil effectively operates as generally lossless air coil while the other part of the coil losses magnetic energy as eddy currents develop on the portion of the core 10 that overlaps with the bore of the coil 4. Core losses transform energy to heat in the core 10 as eddy currents develop across the core 10 in the overlapping portion and the coil 4 start to loose it's ability to resist current changes when the oscillator output $V_{S1}$ changes from VCC1 to ground and vice versa. Therefore, in state B more and more current is consumed by the circuit 5B as the core is being inserted into the bore of the coil 4 and therefore the voltage drop across R6 of FIG. 5A increases, resulting in the lower output voltage $V_{VCC1}$ and lower span of the oscillator voltage $V_{S1}$. In state C, the core 10 is fully inserted into the bore of the coil 4 as seen in FIG. 3A. Therefore, by the above discussion, the energy loss and the current draw is at maximum. It should be noted however, that it was found that the coil 4 still maintains relatively close inductance value relative to the air coil position 3B, the inductance does not drop significantly so as to allow unrestricted current flow from the oscillator output $V_{S1}$ to the capacitor C3 of FIG. 5B and vice versa. Therefore, even though the current draw of the circuit 5B is increased in states B-D relative to states A, E, it is still typically very small and easily supplied by the sound module. To complete the illustration, in state D the core 10 is being pulled back from the bore of the coil 4 until reaching full exit state E as in FIG. 3B. However, the analysis of the circuit follows exactly the same principles as discussed in states B and A therefore for the sake of brevity will not be discussed again.

To summarize, when a voltage VCC1 is applied to the circuit of FIG. 5B, a variable current is consumed in proportion to the insertion of core 10 into the bore of the coil 4. Electronically, the hi hat controller appears to the sound much like a pseudo resistor, which forms a resistor divider with R6 shown in FIG. 5A. The circuit generates internally an oscillating voltage waveform at the output point S1, as shown in FIG. 6, while an averaged voltage value VCC1 presented at the circuit output is used for sensing purposes in the sound module. VCC1 is the signal that is sent back through the connector tip T in FIG. 5A, B to be sensed by the ADC referred to in FIG. 5A. For all intents and purposes, the circuit of FIG. 5B appears as a variable resistance, dependent upon the position of the core 10 in the coil 4 of FIGS. 1 and 4. As will be appreciated by one skilled in the art, any number of equivalent circuits might be substituted here.

In essence, referring again to FIGS. 1-4, the first embodiment of the invention discloses a hi hat controller 100 for detection of vertical position of an electronic percussion instrument 300 which is adapted to be operated upward and downward during play on a stand 400 having a foot pedal 42 and a shaft 12 which is movable upward and downward by the foot pedal 42 of the stand 400, the hi hat controller 100 is comprising a housing 1, disposed on the stand 400 below the electronic percussion instrument 300, and a coil 4 supported by the housing 1, and an electronic circuit such as the one of FIG. 5B, constructed either internal or external to the housing 1, for producing alternating electrical current in the coil 4 so as to induce magnetic field in the vicinity thereof, and a core 10, comprising a metallic material, variably positioned in the vicinity of the coil 4 induced with magnetic field, the position of the core 10 relative to the coil 4 is configured to change as the electronic percussion instrument 300 is being operated upward and downward during play, wherein there is no direct contact between the core 10 and the coil 4, wherein an electrical output signal representative of the measured position is produced by the electronic circuit such that of FIG. 5B in accordance with the position of the core 10 relative to the coil 4.

A design goal of the first embodiment of the invention is to keep the core 10 and coil 4 as close as possible while still without making mechanical contact, since the close proximity increases the current induced in the core 10 by the magnetic field produced by the coil 4. The stronger current cause more energy loss and so the output signal becomes with better signal to noise ratio. For this reason the core 10 and the coil 4 are configured to have a tubular shape and to be generally concentric to each other, sharing an axis which coincide about the shaft of the stand. As the magnetic field in the bore of the coil 4 is the strongest, the core 10 is configured to be protruding the bore of the coil 4 for maximal signal output. Furthermore, the continuous upward and downward protrusion of the core 10 into the bore of the coil 4 during play also allows for an output signal which is continuous and varying in accordance with the position of the core 10 relative to the coil 4, thereby benefiting the production of suitable sound to be played by the sound module to the player which is in accordance with the detected vertical position.

Figure 7:
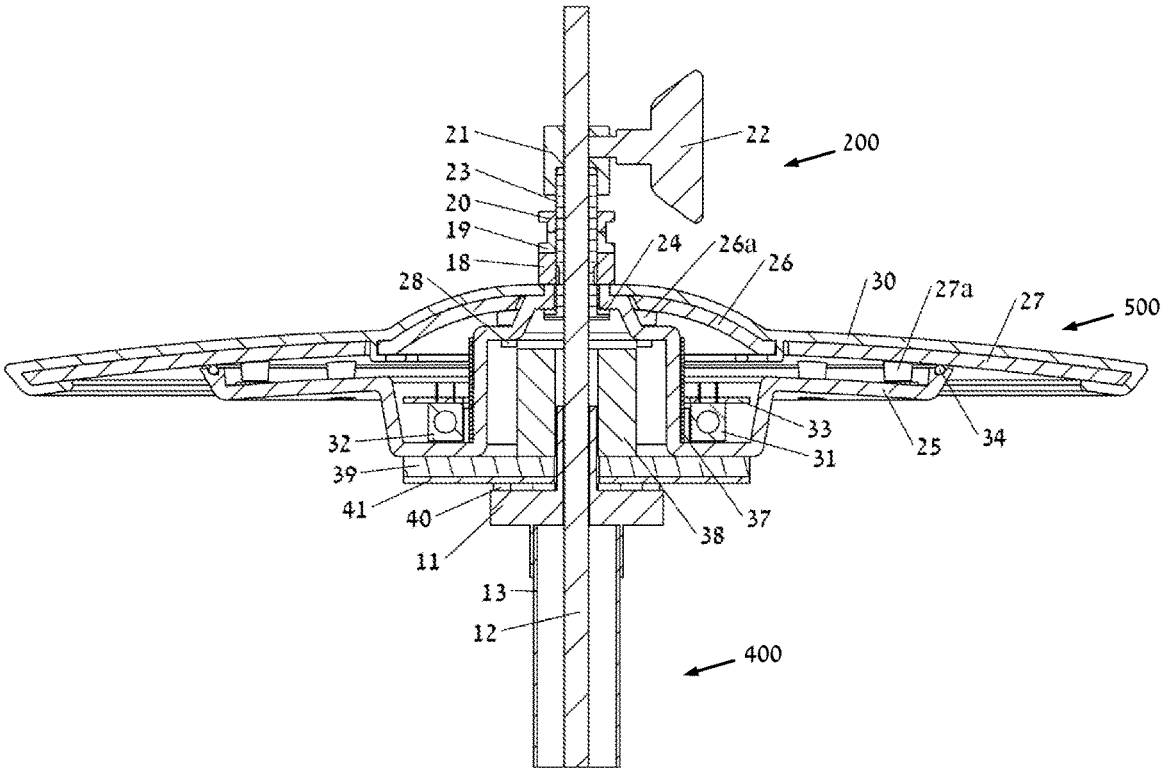
FIG. 7 shows a second embodiment of the invention, in which position detection apparatus is embedded into the electronic percussion instrument.

The hi hat controller disclosed in FIGS. 1-4 may also be constructed as an integral part of the hi hat cymbal. Referring to FIGS. 7 and 8, an exemplary electronic percussion instrument 500 is disclosed according to the second embodiment of the invention. The principle of operation of the electronics is the same and the discussion regarding FIGS. 5 and 6 applies to this embodiment without modifications. Referring to FIG. 7, a support frame 25 typically made of rigid material such as plastic, is serving as a base for the electronic percussion instrument. A support cup 26 and a support disc 27, also rigid and typically made of plastic are disposed over the support frame 25. The support cup 26 is configured to have bosses 26*a* extending from below for receiving screws 28, fixing the support cap 26 onto a central portion of the support frame 25. Moreover, the support disc 27 is also configured to have plurality of bosses 27*a* for securing it to the frame 25 using screws, not shown. An elastomer 34, generally having the shape of a rubber band having circular cross section, is inserted at the boundary of contact between the support frame 25 and support disc 27, providing an elastic material separation between two rigid bodies in order to eliminate undesirable clicking sounds between the rigid bodies 25 and 27 when the electronic percussion instrument 500 is struck. A cover 30, made of elastic material such as rubber, is disposed over the support cup 26 and support disc 27, the cover 30 has a top surface which defines the area playable by a percussionist. It is noted that for the illustrative purposes of this embodiment of the invention there is no difference if the support cup 26 and a support disc 27 are formed as two structural pieces or as one unified piece, as long they provide rigid support so as to hold the shape of the flexible cover 30 and support it from beneath. Furthermore it is noted that an interior section having space for disposal of interior components is enclosed between the support frame 25 and the support cup 26 and support disc 27. Not shown is a vibration sensor, typically a piezoelectric disc type, which is disposed in the interior section by means of adhesive or adhesive tape, the vibration sensor is used to convert mechanical vibrations induced by percussive stroke to electrical signals for interpretation externally by the sound module. Connectors 31 and 32 are disposed within the interior of the support frame 25, such that one end of the connectors 31 and 32 protrude through holes in the support frame 25 to allow connection with external cables, not shown. A PCB 33 is disposed in the interior section and affixed to the support frame 25 using screws, not shown. The PCB 33 include electrical pads for soldering to the leads of the connectors 31 and 32, supporting them mechanically and also electrically connected to them. The PCB 33 is also used for electrical connection between the vibration sensor via wires and may include connection to additional sensors as well, as needed for the operation of the electronic percussion instrument. However, as the scope of this invention is on the upward and downward position sensor, any additional sensors are not further described. It is noted however, in the described embodiment two connectors 31, 32 are preferably used, although not necessarily required. One of the connectors 31,32 is used for the purpose of the current invention, namely the upward and downward detection of the position of the electronic percussion instrument, while the other connector is reserved for other signals required by the electronic percussion instrument, such as the vibration sensor and so called cymbal choke detection sensor.

To summarize, as for the second embodiment of the invention shown in FIGS. 7-8, the position detection apparatus is embedded into the electronic percussion instrument 500. For this reason, some adaptations are evident in the structure of the electronic percussion instrument 500. The embedded position detection apparatus of the second embodiment of the invention comprises an electronic percussion instrument 500, configured to be movable upward and downward during play on a stand 400 and comprise a striking surface on an upper face thereof for receiving percussion strokes, and a support frame 25 for supporting it from below such that an interior section is formed between the support frame 25 and the striking surface, and a coil 37 disposed and supported in the interior section, and an electronic circuit 35 constructed for producing alternating electrical current in the coil 37 so as to induce magnetic field in the vicinity thereof, and, a core 38, comprising a metallic material, stationarily positioned on the stand 400 external to the electronic percussion instrument 500 from below such that the core 38 is adapted to be variably protruding into the bore of the coil 37 through an opening on a central lower portion of the support frame 25 as the electronic percussion instrument 500 is being moved upward and downward on the stand during play, wherein an electrical output signal representative of the measured upward and downward position of the electronic percussion instrument 500 is produced by the electronic circuit in accordance with the position of the core 38 relative to the coil 37.

It should be noted that in the second embodiment of the invention the core 38 is configured to have some clearance with the coil 37. Similar to the first embodiment of the invention, the core 38 and the coil 37 have a tubular shape such that the core 38 is variably positioned upward and downward in the bore of the coil 37 during play. The core 38 and the coil 37 are disposed such that they are concentric to each other and about the shaft 12. As disclosed hereinabove, this maximizes the signal to noise ratio of the vertical position apparatus as the core 38 is configured to be variably protruding bore of the coil 37, a location having the highest strength magnetic field, therefore having maximal influence on the output signal. However, unlike the first embodiment of the invention, there is some clearance in between the core 38 and the coil 37. This is necessary to allow the electronic percussion instrument 500 to swing with rocking motion as it is being struck. The clearance obviously reduce the signal to noise that could have been achieved however practically it was found that the signal is more than enough and can be measured with excellent results. Furthermore, the rocking motion of the electronic percussion instrument 500 during percussion strike was found to have only minor influence on the resulting signal. In other words, slight deviation in concentricity between the principle axes of the core 38 and the coil 37 have only minor effect on the output signal, a very desirable property of the second embodiment of the invention, allowing for swinging motion of the electronic percussion instrument 500 on the stand 400 to occur during play.

It is further emphasized that the circuit for producing alternating current may be incorporated into the PCB 33 of FIG. 7, or it may produced external to the electronic percussion instrument 500 in which case alternating current is brought to one of the connectors 31,32 by means of a shielded cable. In the later case the electronic circuit typically of FIG. 5B is incorporated into an external sound module, where alternating current is produced and the current consumption of the oscillation circuit is taken as the signal output representative of the position sought. In the current invention however, preference is given to internal generation of alternating currents in the PCB 33, because of the close proximity between the oscillation circuit and the coil reduce noise in the overall system.

The apparatus disclosed by the embodiments of the invention has the following benefits. First, as a frictionless, contactless apparatus, there is no wear therefore the service life is long. Secondly, the apparatus disclosed draws very small amounts of currents, therefore no additional power supply is needed for its operation, the small current needed can be drawn directly from the measuring circuit as if the device was mimicking a variable resistor. Thirdly, the accuracy of the detected vertical position is high, the output signal changes in continuous manner as the electronic percussion instrument is moved upward and downward, therefore the detectable range is accurate and continuous, i.e not limited to discrete positions.

In one embodiment of the invention, the PCB 33 include the components of the oscillator circuit such as the circuit of FIG. 5B and is also electrically connected to a coil 37. The coil 37 is disposed on an internal protrusion formed on the support frame 25, mechanically supporting the coil 37 and fixing it to the support frame by means of glue. It is noted that the coil 37 is produced separately from support frame 25, by methods known to the art; such a coil is also known as a bobbin-less coil, or air coil. The electronic percussion instrument 500 is seated on an off the shelf hi hat stand 400, adapted to provide a wider support base for the electronic percussion instrument 500. A seating plate 41, typically a metallic part, is disposed over a typical cushion 40 which is usually a member of off the shelf hi hat stands. Another cushion 39 is disposed over the seating plate 41 to provide support for the electronic percussion instrument 500. Typically, the cushions 39 and 40 are made of felt or rubber so as to minimize click noises when the electronic percussion instrument 500 is played. Although not shown in the figures, it is noted that the seating plate 41 could have also been constructed to have a shape and appearance that mimics the bottom cymbal of an acoustic hi hat. The seating plate 41 has function is support for the electronic percussion instrument 500 while struck, regardless of it's shape.

Figure 8A:
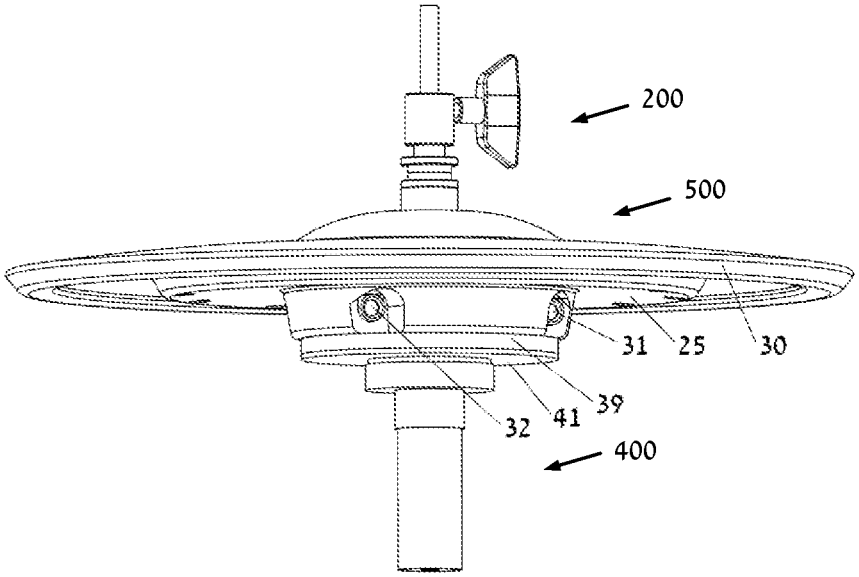
FIGS. 8A, 8B show a second embodiment of the invention in closed and open positions.
Figure 8B:
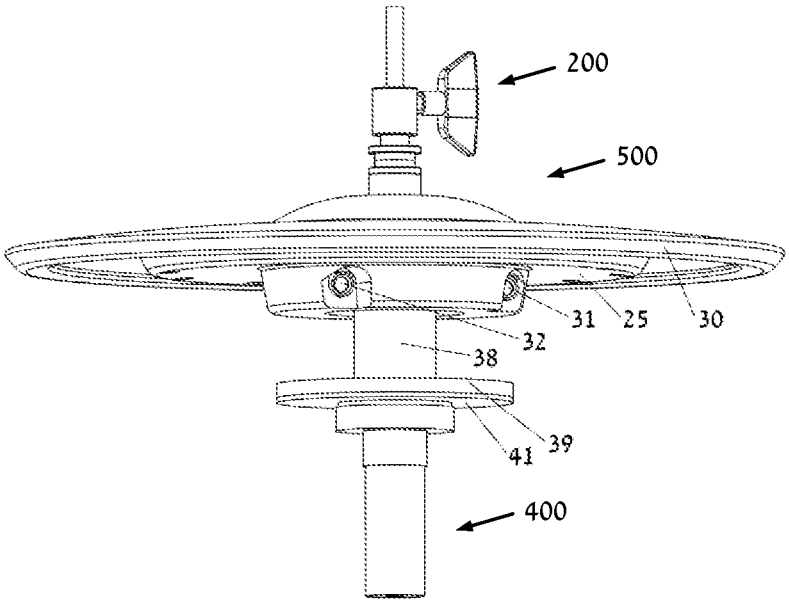

The electronic percussion instrument 500 is able to move up and down, operated by the percussionist's foot. FIGS. 8A and 8B details the mounting of the electronic percussion instrument 500 on a typical off the shelf stand 400 and typical hi hat clutch 200. When the percussionist's foot is pressing on the foot pedal 42 of the stand 400, the hi hat is referred to as closed position, shown in FIG. 8A. When the percussionist's foot is not pressing on the foot pedal 42, the hi hat is referred to as open position, shown FIG. 8B. The electronic percussion instrument 500 is affixed to the shaft 12 by a so called hi hat clutch 200 known to the art. The hi hat clutch is generally an off the shelf component although some modification are made for proper mating with the electronic percussion instrument 500.

The core 38 is central to the invention of the electronic percussion instrument 500 which is designed for vertical position detection. The core 38 is acting electronically in the same manner as the core 10 of the hi hat controller 100, shown in FIGS. 1 and 3, however, some adaptations are evident from their shapes for suiting their function in the related embodiments. Referring to FIG. 7, the core 38 is statically placed over the cushion 39, sharing the same central axis with the electronic percussion instrument 500 and the hi hat stand 400. The core 38 has a central hole in which a protrusion of the cymbal seat 11 and the shaft 12 pass through, and is held at rest on the cushion 39, regardless the position of the electronic percussion instrument 500. The core 38 comprises metallic material preferably having high magnetic permeability, and is placed into the bore of the coil 37 which is able to move with the support base 25 when the hi hat is operated by the percussionist's foot. Alternating current flowing through the coil 37 is inducing magnetic field in the bore of the coil where the core is positioned, and some loss of energy will occur depending on the relative position of the core's protrusion into the bore of the coil 37. The energy loss is due to so called eddy currents induced in the core 38, which flow through the, however small but non zero, resistance of the metallic material composing the core 38. The amount of energy loss is generally proportional to the protrusion of the core 38 into the bore of the coil 37 and can be measured by the sound module. In other words, the amount of overlapping between the core 38 and the coil 37 determines the portion of the core 38 in which eddy currents will predominantly flow, leading to measurable increase in the current consumption of the oscillating circuit such that of FIG. 5B.

It should be emphasized that the while the first and second embodiments of the invention differ in construction, they are sharing the same operation principle and are directed to solve the same problem. In the first embodiment on the invention the coil 4 is stationary while the core 10 is moving upward and downward with the electronic percussion instrument. In the second embodiment of the invention, the core 38 is stationary while the coil 37 is moving upward and downward with the electronic percussion instrument. For the sake of the discussion hereinbelow, the coil 4 and the coil 37 will be simply referred to as coil, omitting the reference numeral, and the discussion pertains to both embodiments. Likewise, the core 10 and the core 38 will be simply referred to as core hereinbelow, omitting the reference numeral, and the discussion pertains to both embodiments.

In both cases the amount of protrusion of the core into the bore of the coil directly influence the amount of eddy currents induced predominantly in the protruding section of the core and therefore influence the amount of overall current consumption of the oscillating circuit, which is measured to deduce the vertical position of the electronic percussion instrument. Such deduction is straight forward, and will be described again shortly. Assuming for a moment the electronic percussion instrument is held at most upward position, such that the core is not protruding but is just above the coil, in such case there is some quiescent current needed by the oscillation circuit to oscillate even though essentially no eddy currents are induced in the core. This amount of current is known by design of the circuit and the coil, or even can be measured as a calibration step for maximal accuracy prior to first operation of the detection apparatus. Note that setting the electronic percussion instrument to any position higher than mentioned hereinabove is possible mechanically, but the current consumption of the electronic circuit will essentially not change further, signifying a top boundary for position detection of the disclosed invention which is a design parameter configured with the height of the coil and its protruding core. Now, assuming the most downward position of the electronic percussion instrument is taken, where the core is maximally protruding into the core. In such case, maximal amount of eddy currents are induced in the core and therefore the current consumption of the electronic circuit is the highest. Again, this can be measured once in factory for all devices or for maximal accuracy can be measured individually to each apparatus as a calibration stage before first operation. In either case, this current is taken as the position of maximal protrusion. Now, it is easy to find any intermediate position in between the most upward and downward positions, as the current consumption of the circuit changes in proportion to the amount of the protrusion of the core in to the bore of the coil.

In summary, regardless of the construction of first and second embodiments, the current invention discloses an electronic hi hat cymbal apparatus for detection of vertical movement, comprising an electronic percussion instrument, configured to have a shape resembling of the top cymbal of an acoustic hi hat and further configured to be reversibly attached to a shaft of a stand such that the electronic percussion instrument is movable upward and downward by a foot pedal operating the shaft, and a coil, induced with alternating current so as to produce magnetic field in the vicinity thereof by an electronic circuit which is configured for oscillation, and a core, comprising metallic material, disposed such that it is overlapping with the coil during play, wherein the overlapping portion is configured to vary with the upward and downward movement of the electronic percussion instrument such that eddy currents are formed in the core substantially in the overlapping portion thereof, wherein the electronic circuit has an electronic output signal which vary in accordance to the overlapping portion.

It is further emphasized that while the embodiments of the invention have disclosed a core protruding the bore of a coil, the same principle of operation could have been applied to the invention configured to work the opposite way where the coil is configured to protrude a central hole in the core. Naturally, the magnetic fields always form closed circles and are produced in the interior and exterior of the coil, therefore configuring the core to encircle the coil would produce the same effect of eddy current loss, as magnetic fields exterior to the coil are captured in the bore of the core. Therefore, any overlapping between the core and the coil is possible provided that the overlapping is configured to be within the range of the magnetic field produced by the coil. Furthermore, either the coil or the core can be moving while the other is held at rest. Therefore, it is emphasized that all the four mechanical configurations are possible using the same principle of operation: a stationary coil encircling a moving core, a moving coil encircling a stationary core, a stationary core encircling a moving coil, and a moving core encircling a stationary coil. To facilitate the four different configurations, the mechanical structure has to take into consideration of the integrity of the coil, as the coil usually a delicate winding of wires that can be damaged if not properly supported, therefore wherever a stationary coil is used exterior to the electronic percussion instrument, it should have a protective housing supporting it. On the other hand, a core comprising metallic material such as iron can be made very strong and does not need any encapsulation if placed stationary on a stand.

To summarize, the four mechanical options are repeated with the required mechanical encapsulation. First option is a stationary coil supported by a housing external to the electronic percussion instrument, the coil is encircling a moving core coupled to the electronic percussion instrument. Second option is a moving coil which is embedded into the electronic percussion instrument, the coil is encircling a stationary core disposed on a stand external to the electronic percussion instrument. Third option is a stationary core disposed on a stand external to the electronic percussion instrument, the core is encircling a moving coil which is embedded into the electronic percussion instrument. And lastly the fourth option is a moving core which is coupled to the electronic percussion instrument, the core is encircling a stationary coil supported by a housing external to the electronic percussion instrument. In the disclosure above, the first option was described in detail in the first embodiment of the invention and the second option was described in detail in the second embodiment of the invention. However as mentioned the third and forth options are possible as well.

The foregoing description and illustrations of the embodiments of the invention has been presented for the purposes of illustration. It is not intended to be exhaustive or to limit the invention to the above description in any form.

To justly and entirely describe renditions of each embodiment may not yield full reportage of underlying concepts. Thus we may generally articulate that not all embodiments are necessarily described herein, but that the concepts underlying the invention are fully disclosed.

Any term that has been defined above and used in the claims, should be interpreted according to this definition.

The reference numbers in the claims are not a part of the claims, but rather used for facilitating the reading thereof. These reference numbers should not be interpreted as limiting the claims in any form.

What is claimed is:

1. A hi hat controller for detection of vertical position of an electronic percussion instrument which is adapted to be operated upward and downward during play on a stand having a foot pedal and a shaft which is movable upward and downward by the foot pedal of the stand, comprising:

a housing, disposed on the stand below the electronic percussion instrument;

a coil supported by the housing;

an electronic circuit constructed for producing alternating electrical current in the coil so as to induce magnetic field in the vicinity thereof; and, a core, comprising a metallic material, variably positioned in the vicinity of the coil induced with magnetic field, the position of the core relative to the coil is configured to change as the electronic percussion instrument is being operated upward and downward during play, wherein there is no direct contact between the core and the coil, wherein an electrical output signal representative of the measured position is produced by the electronic circuit in accordance with the position of the core relative to the coil.

2. The hi hat controller according to claim 1 wherein the core is configured to have a tubular shape and is made of iron; wherein the coil is configured to have tubular shape; and, wherein the core is variably positioned upward and downward in the bore of the coil during play.

3. The hi hat controller according to claim 1 wherein the coil and the core are arranged generally concentric about the shaft of the stand.

4. The hi hat controller according to claim 1 further comprising a connector for receiving an electrical connection from an external processing device, the connector is disposed interior to the housing such that an opening of the connector for mating a cable is protruding through an opening in the housing.

5. The hi hat controller according to claim 1 wherein the electrical output signal is based on the current consumption of the electronic circuit.

6. The hi hat controller according to claim 1 wherein the electronic circuit is disposed in the interior of the housing, so as to produce alternating current adjacent to the coil.

7. The hi hat controller according to claim 1 wherein the electronic circuit is disposed exterior to the housing on an external device, thereby alternating current is remotely produced and transmitted to the coil.

8. The hi hat controller according to claim 1 wherein the core and the coil are incorporated into the foot pedal of the stand, for detection of the upward and downward motion of the electronic percussion instrument.

9. The hi hat controller according to claim 1 wherein the current consumption of the electronic circuit is configured to be less than 1 milliampere.

10. The hi hat controller according to claim 1 wherein the electronic percussion instrument is configured to have a shape of a top hi hat cymbal.

11. The hi hat controller according to claim 1 wherein the housing is configured to have a shape of a bottom hi hat cymbal.

12. An embedded position detection apparatus, comprising:

an electronic percussion instrument, configured to be movable upward and downward on a stand during play, comprising a striking surface on an upper face thereof for receiving percussion strokes and a support frame for supporting the electronic percussion instrument from below, such that an interior section is formed between the support frame and the striking surface;

a coil disposed and supported in the interior section;

an electronic circuit constructed for producing alternating electrical current in the coil so as to induce magnetic field in the vicinity thereof; and, a core, comprising a metallic material, stationarily positioned on the stand external to the electronic percussion instrument from below such that the core is adapted to be variably protruding into the bore of the coil through an opening on a central lower portion of the support frame as the electronic percussion instrument is being moved upward and downward on the stand during play, wherein an electrical output signal representative of the measured upward and downward position of the electronic percussion instrument is produced by the electronic circuit in accordance with the position of the core relative to the coil.

13. The embedded position detection apparatus according to claim 12 wherein the core is configured to have a tubular shape and is made of iron; wherein the coil is configured to have tubular shape; and, wherein the core is variably positioned upward and downward in the bore of the coil during play.

14. The embedded position detection apparatus according to claim 12 wherein the coil and the core are arranged generally concentric about a shaft of the stand.

15. The embedded position detection apparatus according to claim 12 further comprising a connector for receiving an electrical connection from an external processing device, the connector is disposed in the interior section such that an opening of the connector for mating a cable is protruding through an opening in the support frame.

16. The embedded position detection apparatus according to claim 12 wherein the electrical output signal is based on the current consumption of the electronic circuit.

17. The embedded position detection apparatus according to claim 12 wherein the electronic circuit is disposed in the interior section of the electronic percussion instrument, so as to produce alternating current adjacent to the coil.

18. The embedded position detection apparatus according to claim 12 wherein the electronic circuit is disposed exterior to electronic percussion instrument on an external device, thereby alternating current is remotely produced and transmitted to the coil.

19. The embedded position detection apparatus according to claim 12 wherein the current consumption of the electronic circuit is configured to be less than 1 milliampere.

20. The embedded position detection apparatus according to claim 12 wherein the electronic percussion instrument is configured to have a shape of a top hi hat cymbal.

21. The embedded position detection apparatus according to claim 12 further comprising a bowl shaped member, stationarily disposed on the stand below the electronic percussion instrument so as to simulate the look of an acoustic hi hat cymbal.

22. An electronic hi hat cymbal apparatus for detection of vertical movement, comprising:

an electronic percussion instrument, configured to have a shape resembling of the top cymbal of an acoustic hi hat and further configured to be reversibly attached to a shaft of a stand such that the electronic percussion instrument is movable upward and downward by a foot pedal operating the shaft;

a coil, induced with alternating current so as to produce magnetic field in the vicinity thereof by an electronic circuit which is configured for oscillation; and, a core, comprising metallic material, disposed such that it is overlapping with the coil during play, wherein the overlapping portion is configured to vary with the upward and downward movement of the electronic percussion instrument such that eddy currents are formed in the core substantially in the overlapping portion thereof, wherein the electronic circuit has an electronic output signal which vary in accordance to the overlapping portion.

23. The electronic hi hat cymbal apparatus according to claim 22, wherein the coil is stationary and supported by a housing external to the electronic percussion instrument, the coil is encircling the core which is coupled to the electronic percussion instrument and is moving during play.

24. The electronic hi hat cymbal apparatus according to claim 22, wherein the coil is embedded into the electronic percussion instrument and is moving therewith during play, the coil is encircling the core which is stationarily disposed on the stand external to the electronic percussion instrument.

25. The electronic hi hat cymbal apparatus according to claim 22, wherein the core is disposed stationarily on the stand external to the electronic percussion instrument, the core is encircling the coil which is embedded into the electronic percussion instrument and is moving therewith during play.

26. The electronic hi hat cymbal apparatus according to claim 22, wherein the core is coupled to the electronic percussion instrument and is moving therewith during play, the core is encircling the coil which is stationary and supported by a housing which is external to the electronic percussion instrument.

27. The electronic hi hat cymbal apparatus according to claim 22, wherein the electronic circuit is disposed in the interior section of the electronic percussion instrument, so as to produce alternating current adjacent to the coil.

28. The electronic hi hat cymbal apparatus according to claim 22, wherein the electronic circuit is disposed exterior to electronic percussion instrument on an external device, thereby alternating current is remotely produced and transmitted to the coil.

* * * * *